United States Patent [19]

DeBlieux et al.

[11] Patent Number: 4,484,066

[45] Date of Patent: Nov. 20, 1984

[54] GARMENT-COUNTING APPARATUS

[76] Inventors: Paul L. DeBlieux, 1677 Pickett Ave., Baton Rouge, La. 70808; Raymond J. Lepine, Jr., 7940 Jefferson Hwy., Baton Rouge, La. 70809; Reginald F. Roberts, Jr., P.O. Box 515, Baton Rouge, La. 70821; Arthur J. Young, 744 Westbrook Dr., Baton Rouge, La. 70815

[21] Appl. No.: 417,394

[22] Filed: Sep. 13, 1982

[51] Int. Cl.[3] ..... G06M 7/04

[52] U.S. Cl. ..... 235/98 C; 235/98 R; 377/6; 221/7

[58] Field of Search ..... 235/98 R, 98 A, 98 C, 235/91 M, 144 ME; 221/7; 377/6

[56] References Cited

U.S. PATENT DOCUMENTS

| | | | |
|---|---|---|---|
| 2,171,124 | 8/1939 | Green | 235/98 A |
| 2,728,392 | 12/1955 | Marsh et al. | 235/98 R X |
| 3,706,027 | 12/1972 | Grice, Jr. et al. | 377/6 X |

*Primary Examiner*—Benjamin R. Fuller

*Attorney, Agent, or Firm*—Reginald F. Roberts, Jr.; Arthur J. Young

[57] ABSTRACT

The present invention provides an apparatus and a method for counting articles. The apparatus comprises a sensor which is adapted to generate a signal characteristic of a tag attached to each article; and means for counting the number of signals, thereby providing a numerical count of the number of articles. The invention is especially adapted to counting articles of cloth such as garments or bedlinens which are routinely and repeatedly laundered or dry-cleaned at the same cleaning establishment.

6 Claims, 5 Drawing Figures

GARMENT-COUNTING APPARATUS

BACKGROUND OF THE INVENTION

This invention relates to apparatus for counting articles. More particularly, this invention relates to apparatus for counting cloth articles to be laundered or dry-cleaned, such as uniforms, garments, and towels.

The commercial laundering and dry-cleaning of such articles, particularly in industrial applications, require an accurate count of the number of articles cleaned. The present method of making such a count is to separate the articles manually and count each article as it is separated from the other articles. This method is costly, time-consuming, and inefficient compared with the automatic method of the present invention.

SUMMARY OF THE INVENTION

In general, the present invention provides apparatus and method for counting articles automatically and efficiently. Apparatus according to the present invention comprises a sensor which is adapted to generate a signal characteristic of a tag attached to each article; and means for counting the number of signals, thereby providing a numerical count of the number of articles.

A "tag" is herein defined as anything capable of interacting with a sensor to produce a signal.

The present invention also provides a method for counting articles, comprising the steps of (a) attaching a tag to each article; (b) providing a sensor adapted to generate a signal characteristic of the tag attached to each article; (c) activating the sensor with the tag, thereby generating a signal characteristic of the tag attached to each article; and (c) counting the number of signals generated by the sensor, thereby obtaining a numerical count of the number of articles.

It is an object of this invention to provide an apparatus and a method for the automatic counting of articles made of cloth. It is a further object of this invention to provide apparatus and method for the automatic counting of several different articles of cloth without requiring a preliminary separation of such articles. It is a further object of this invention to provide apparatus and method for automatically computing the amount charged by a cleaning establishment for laundering and/or dry-cleaning a specific assortment of clothing or other articles made of cloth. Other objects of the invention will be apparent to those skilled in the art from the more detailed description which follows.

DESCRIPTION OF THE PREFERRED EMBODIMENTS

Figure 1:
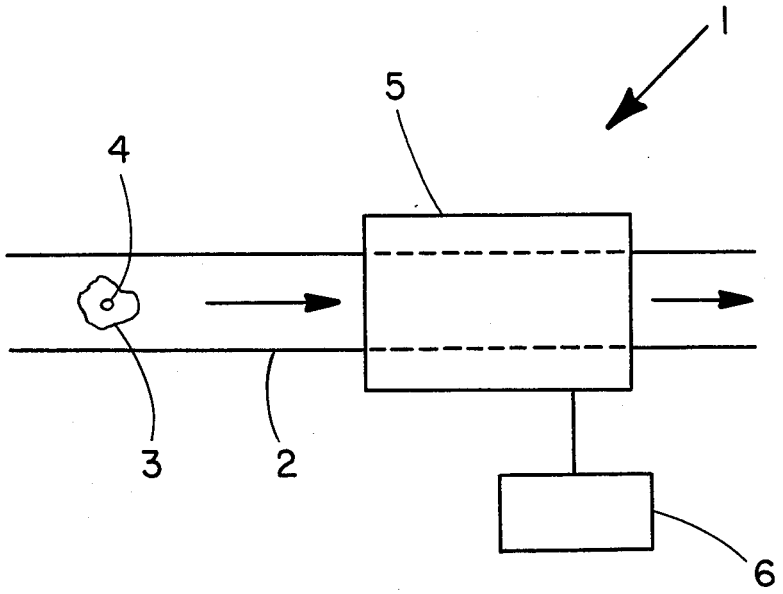
FIG. 1 is a schematic representation of the invention in actual use.

The following description illustrates the manner in which the principles of the present invention are applied, but is not to be construed as in any sense limiting the scope of the invention.

More specifically, the tag may be a source of electromagnetic radiation, and the sensor may be a photocell responsive to the emitted radiation. The tag may be a piece of magnetized metal, and the sensor may be an electroconductive coil through which the magnetized metal is passed, thereby generating a current in the coil; or the tag may be a piece of metal adapted to provide a standard signal, and the sensor may be a metal detector adapted to interact with the tag to generate a signal.

Preferably, the sensor includes a plurality of devices for generating a magnetic field and for measuring changes in the magnetic field. More preferably, the devices are spatially arranged and disposed to provide a signal that is substantially independent of the spatial disposition of the tag attached to each article.

The present invention is especially adapted to counting garments from hospitals or hotels such as bed linen and utility towels which are routinely and repeatedly laundered or dry-cleaned at the same cleaning establishment.

Each article is beneficially provided with the same quantity of metal. More specifically, each article is provided with a known, and reasonably accurately known, quantity of metal. If there are different articles, and if the count is to include the number of each kind of article, known but different quantities of metal are provided for each kind of article. Even more specifically, each article is provided with an amount of metal which is known to produce the same response in a metal detector when the article is passed through the magnetic field of the metal detector at a predetermined and constant rate of speed. In making the count, the article is passed through the same magnetic field at the same rate of speed by, for example, a belt-conveyor. The current induced in the metal detector will then be and is proportional to the number of articles that pass through the field of the detector on the belt-conveyor. Computer means are beneficially connected to the detector to further process the signal from the detector.

It will be understood that different amounts of metal may be added to each article, depending on the amount of metal already present in the article. For example, a garment containing a metal zipper will require a smaller quantity of added metal than a garment which originally contains no metal.

It wll be further understood that, since the current induced is directly proportional to the amount of metal in each article and to the total number of articles, it is possible and beneficial to determine the number of articles by direct readout, using the detector in combination with the computer means. Moreover, by attaching proportional amounts of metal to different articles, for example one and one-half units of metal to shirts and four units to pants, it is further possible to obtain an accurate count of each type of article by dividing the overall sensor responses into known fixed combinations. By using such appropriate combinations of units, several different types of articles can be counted separately at the same time.

It will be further understood that, if only the cost, price, or charge of or for the laundering and/or dry-cleaning is required, and not the number of items cleaned, it will be possible and beneficial to determine and display the total amount charged, total price, or total cost, by direct readout, using the metal detector and computer means, by fixing the amount of metal in each article to be proportional to the cost, price, or charge of or for cleaning that particular article.

More specifically, reference is made to FIG. 1 wherein is shown a schematic representation of garment-counting apparatus 1 according to the present invention in actual operation. A garment 3 which includes a metal tag 4 is transported by a belt-conveyor 2 through the magnetic field of a sensor 5 which includes a metal detector, at a constant and known rate of speed. As the metal tag 4 passes through the magnetic field, the field is distored, thereby producing an electrical, imbalance which generates a signal transmitted to a computer 6.

Figure 2:
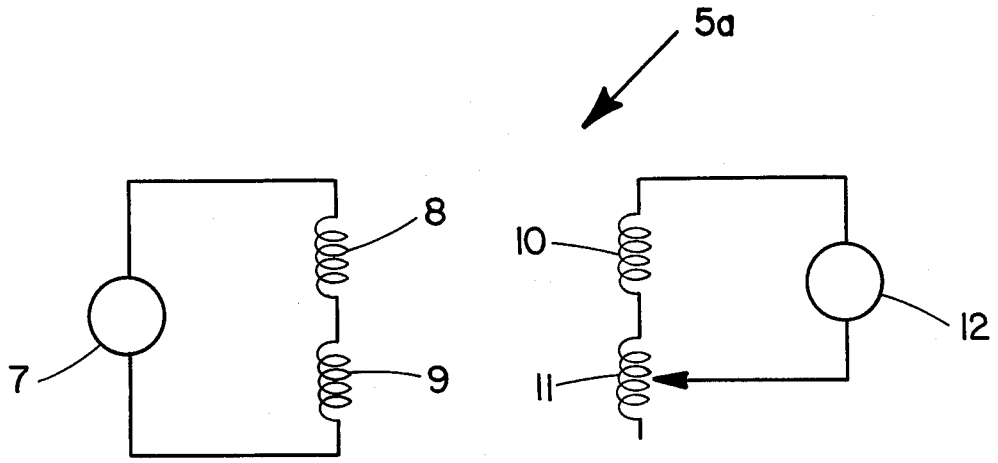
FIG. 2 is a schematic diagram of the essential parts of one type of detector useful in the present invention.

Reference is now made to FIG. 2, which shows the essential elements of a metal detector 5*a* useful in the present invention. The metal detector 5*a* includes a first coil 8, a second coil 9, a third coil 10, and a fourth coil 11. An oscillator 7 generates a signal that is impressed on coils 8 and 9. Coils 10 and 11 are constructed so that coil 10 is in phase with coil 8 and coil 11 is out of phase with coil 9. Coils 8, 9, 10, and 11 are positioned and coil 11 is adjusted so that the signal produced in coil 11 by coil 9 cancels the signal produced in coil 10 by coil 8. The coils 8, 9, 10, and 11 generate a magnetic field that is coaxial with the coils 8, 9, 10, and 11. Power for the oscillator 7 is provided by a battery or other electrical source, not shown.

When a piece of metal is passed through the magnetic field generated by the coils 8, 9, 10, and 11, the magnetic field will be distorted, the coupling between the coils will change, and the signals will no longer cancel. When this occurs, a current passes through and is detected by a current-detector 12. The amount of current is directly proportional to the quantity of metal which traverses the magnetic field.

To prevent permanent magnetization of the metal tags caused by the magnetic field, it is beneficial to employ metals that are incapable of acquiring permanent magnetization. Actually, there are very few metals, notably including iron, which are capable of being permanently magnetized. Accordingly there is a wide range of choice for selecting a metal out of which to make the metal tags. Preferably, the metal chosen is copper, tin, or aluminum. It is to be understood, of course, that various combinations of such metals may be so employed.

The current-detector 12 of FIG. 2 may be an ammeter or a micro-ammeter. Preferably, the current-detector 12 includes an analog computer adapted to respond proportionately to the flow of current through the current-detector 12, and the computer 6 of FIG. 1 is preferably a digital computer. The current-detector 12 is connected to the computer 6 by known means such as an analog-to-digital converter, not shown.

In the preferred method of using the present invention, the sensor 5 comprises a plurality of metal detectors, the essential components of which are shown in FIG. 2 and therein designated by the numeral 5*a*. Since the magnetic field strength is inversely proportional to the square of the distance from the source, and since the distortion of the magnetic field by a piece of metal moving through the field is in general dependent on the orientation of the metal with respect to the field, the metal detectors are spatially arranged and disposed to provide a signal that is substantially independent of the spatial disposition of the tags attached to the garments, including the distance of the tagged garments from the metal detectors and the orientation of the tags with respect to the metal detectors. The following examples, by no means exhaustive or limiting, illustrate preferred methods of using the present invention.

A first detector is positioned to generate a magnetic field in a horizontal direction perpendicular to the belt-conveyor 2, and a second detector to generate a magnetic field in a vertical direction perpendicular to the belt-conveyor 2. Alternatively, first, second, and third detectors may be arranged to generate first, second, and third magnetic fields in a vertical plane perpendicular to the belt-conveyor 2, said magnetic fields forming angles of approximately 120 degrees with each and one another. The current readings from all of the detectors are averaged together to form one output signal. The effect of either arrangement is to average out the effect of various orientations and dispositions of the metal tags 4 with respect to the magnetic fields, including the distance of the tags from the metal detectors and their orientation with respect to the detectors.

Instead of the oscillator 7, a source of steady direct current or of alternating current may be used to activate the coils 8, 9, 10, and 11. If desired, the apparatus 1 may include means, not shown, for shielding the metal detectors from metal parts other than the tags 4. The apparatus 1 may further include means, not shown, for signalling an overload of garments 3 beyond the capacity of the cleaning equipment.

While the tag 4 may be of any shape, it is beneficially shaped to minimize effects due to spatial orientation. Preferred embodiments include a rectangular sheet, a round sheet, a sphere, a cross, a cube, a tetrahedron, an octahedron, a dodecahedron, an icosahedron, an asterisk, a starfish, and a circular ring. Of these, the sphere is preferred as it completely eliminates the factor of spatial orientation because of its perfect symmetry. Other shapes suitable for the practice of this invention will readily suggest themselves to those skilled in the art.

Figure 3:
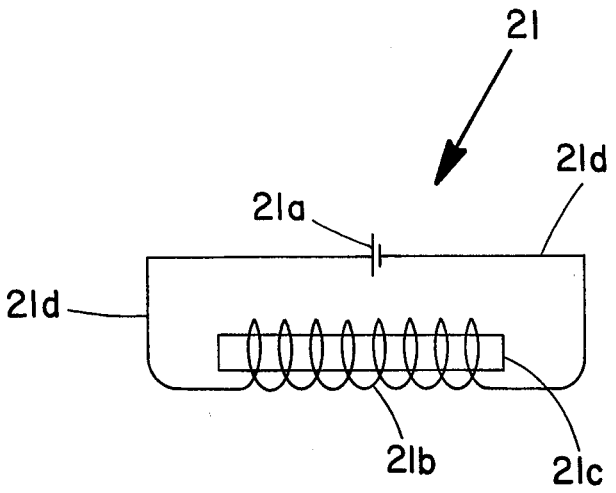
FIG. 3 is a schematic diagram of one component of another type of detector useful in the present invention.
Figure 4:
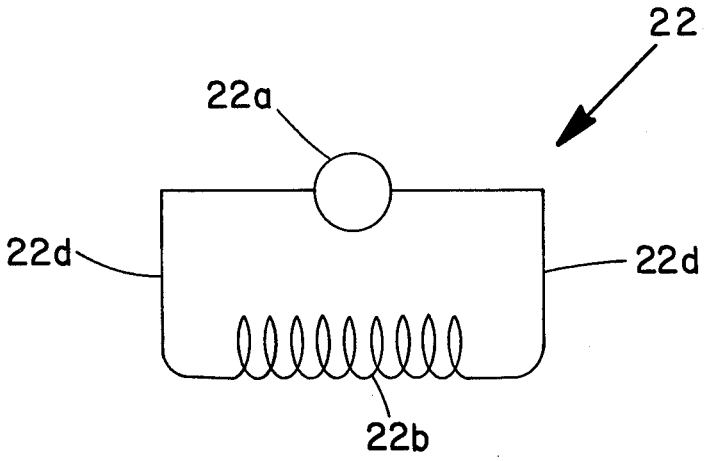
FIG. 4 is a schematic diagram of a second component of that type of detector.

In the preceding examples, the tagged articles are passed between metal detectors similar to the detectors shown in FIG. 2 as 5*a*, each such detector including a plurality of coils 8, 9, 10, and 11. In an alternative embodiment of this invention, the tagged articles are passed between a pair of coils, one of the coils acting as a primary coil and the other as a secondary coil. A detector particularly adapted to and for this embodiment is shown in FIGS. 3 and 4. Each such detector comprises a first component 21, FIG. 3, and a second component 22, FIG. 4.

The first component 21 includes a battery 21*a* connected by metal wires 21*d* to a series of metal coils 21*b* containing an iron core 21*c*. The coils 21*b* and core 21*c* comprise a solenoid. The entire assembly for the first component 21 is beneficially enclosed in a non-conductive container, not shown.

The second component 22 includes a current-detector 22*a*, adapted to measure the amount of current flowing through a series of metal coils 22*b*. The current-detector 22*a* and coils 22*b* are connected by a pair of metal wires 22*d*. The entire assembly for the second component 22 is beneficially enclosed in a non-conductive container, not shown.

Figure 5:
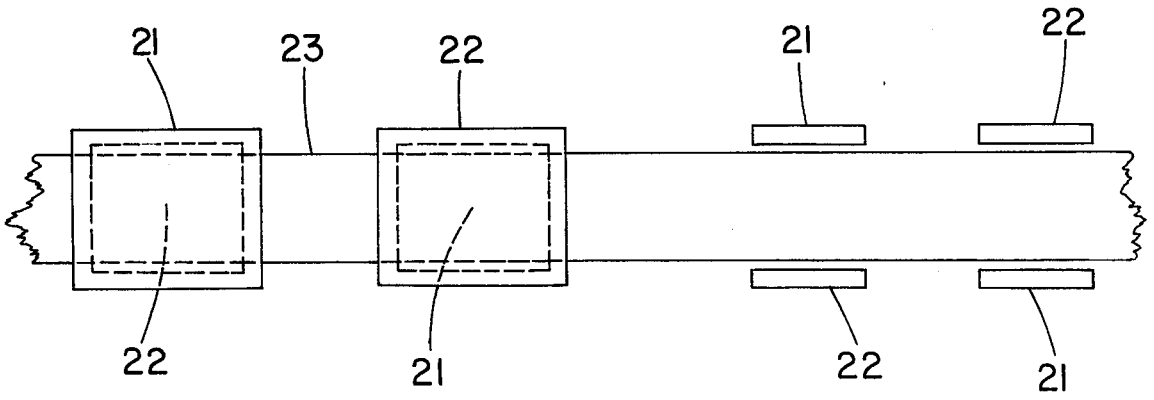
FIG. 5 is a top plan view of a preferred embodiment of the present invention.

Referring now to FIG. 5, it is seen that, by passing an article 3 tagged with a metal tag 4 on a belt-conveyor 23 as shown, it is possible to obtain an accurate measure of the quantity of metal passing through the magnetic fields generated by the components 21, despite the distance variation of the tags 4 from the components 22. In this embodiment of the invention, two pair of components 21 and 22 are used to average the effect of variations in distance of the tags 4 from the components 21 and 22 in a vertical plane, and two pair of components 21 and 22 are used to average the effect of variations in distance of the tags 4 from the components 21 and 22 in a horizontal plane. Any effect due to variations in orientation of the tags 4 with respect to the magnetic fields is beneficially eliminated by the use of metal spheres for the tags 4, thereby making the tags 4 completely symmetrical.

The current-detector 22*a* shown in FIG. 4 may be an ammeter or a microammeter. Preferably, the current-detector 22*a* includes an analog computer adapted to respond proportionately to the flow of current through the current-detector 22*a;* and a digital computer, not shown, is beneficially connected to the current-detector 22*a* by known means such as an analog-to-digital converter, not shown.

The metal from which the tags 4 are made is preferably a metal incapable of acquiring permanent magnetization. Even more preferably, the metal is copper, tin, aluminum, or a combination thereof.

While certain representative embodiments and details have been shown for the purpose of illustrating the present invention, it will be apparent to those skilled in the art that various changes and modifications can be made therein without departing from the spirit and scope of the invention.

We claim:

1. An apparatus for counting articles, comprising: a piece of metal attached to each article; a plurality of detectors, each of which generates a magnetic field, and measures a change in the magnetic field when the piece of unmagnetized metal attached to each article passes through the field, thereby generating a signal characteristic of the piece of unmagnetized metal, the detectors spatially arranged and disposed to generate a signal that is substantially independent of the spatial orientation and disposition of unmagnetized the piece of metal attached to each article; and means for counting the number of signals, thereby providing a numerical count of the number of articles.

2. The apparatus of claim 1, wherein the metal is incapable of permanent magnetization.

3. The apparatus of claim 2, wherein the metal is copper, tin, or aluminum.

4. A method for counting articles, comprising the steps of:

(a) attaching a piece of unmagnetized metal to each article;

(b) passing the tagged article through a magnetic field, thereby causing a change in the magnetic field;

(c) detecting the change in the magnetic field by means of a plurality of detectors responsive to the change in the magnetic field, the detectors spatially arranged and disposed to generate a signal that is substantially independent of the spatial orientation and disposition of the piece of metal attached to each article; and (d) counting the number of signals, thereby obtaining a numerical count of the number of articles.

5. The method of claim 4, wherein the metal is incapable of acquiring permanent magnetization.

6. The method of claim 5, wherein the metal is copper, tin, or aluminum.

* * * * *